US008863664B2

(12) United States Patent
Yamazaki et al.

(10) Patent No.: US 8,863,664 B2
(45) Date of Patent: Oct. 21, 2014

(54) IGNITER ASSEMBLY

(75) Inventors: Masayuki Yamazaki, Hyogo (JP); Naoki Matsuda, Hyogo (JP)

(73) Assignee: Daicel Corporation, Osaka-Shi (JP)

( * ) Notice: Subject to any disclaimer, the term of this patent is extended or adjusted under 35 U.S.C. 154(b) by 121 days.

(21) Appl. No.: 13/293,534

(22) Filed: Nov. 10, 2011

(65) Prior Publication Data

US 2012/0118189 A1 May 17, 2012

Related U.S. Application Data

(60) Provisional application No. 61/413,106, filed on Nov. 12, 2010.

(30) Foreign Application Priority Data

Nov. 12, 2010 (JP) ..... 2010-253423

(51) Int. Cl.
*F42C 11/00* (2006.01)
*F42B 3/195* (2006.01)

(52) U.S. Cl.
CPC ..... *F42B 3/195* (2013.01)
USPC ..... 102/202.14; 280/728.1

(58) Field of Classification Search
CPC ..... F42B 3/04; F42B 3/103; F42B 3/121; F42B 3/127; F42B 3/10; B60R 21/2644; F42C 19/0838
USPC ..... 102/202.14; 280/728.1
See application file for complete search history.

(56) References Cited

U.S. PATENT DOCUMENTS

| | | | | | |
|---|---|---|---|---|---|
| 2,393,629 | A * | 1/1946 | Grant, Jr. | 102/202.9 |
| 5,204,491 | A * | 4/1993 | Aureal et al. | 102/202.14 |
| 5,431,101 | A * | 7/1995 | Arrell et al. | 102/202.5 |
| 5,686,691 | A * | 11/1997 | Hamilton et al. | 102/202.5 |
| 6,009,809 | A * | 1/2000 | Whang | 102/202.7 |
| 6,502,512 | B2 * | 1/2003 | Riviere et al. | 102/202.7 |
| 6,553,914 | B2 * | 4/2003 | Hosey et al. | 102/530 |
| 6,796,580 | B1 * | 9/2004 | Kubo et al. | 280/741 |
| 6,820,556 | B1 * | 11/2004 | Oda | 102/202.7 |
| 7,614,875 | B2 * | 11/2009 | Katsuda et al. | 431/253 |
| 7,726,241 | B2 * | 6/2010 | Stevens | 102/202.12 |
| 7,726,242 | B2 * | 6/2010 | Stevens | 102/202.12 |

(Continued)

FOREIGN PATENT DOCUMENTS

| | | | |
|---|---|---|---|
| JP | 2007-132531 | A | 5/2007 |
| JP | 2008-18856 | A | 1/2008 |
| JP | 2008-49941 | A | 3/2008 |

*Primary Examiner* — Samir Abdosh
(74) *Attorney, Agent, or Firm* — Birch, Stewart, Kolasch & Birch, LLP

(57) ABSTRACT

An igniter assembly includes, an igniter body having an ignition portion and an electroconductive pin, a substantially cylindrical collar surrounding and retaining the igniter body, and a tubular holder disposed inside the collar and surrounding the electroconductive pin to connect the electroconductive pin to a connector. The igniter body, the collar, and the tubular holder are separate members, and are integrated by a resin (provided that the holder is not fitted by being inserted into the collar or a resin portion covering the collar). The tubular holder has a tubular body portion and a convex portion covered by the resin and formed on an outer circumferential surface of the tubular body portion in the diametrical direction or on an inner circumferential surface of the tubular body portion in the diametrical direction. A fitting portion is provided to the inner circumferential surface of the tubular body portion for fitting the connector.

15 Claims, 4 Drawing Sheets

(56) References Cited

U.S. PATENT DOCUMENTS

| | | | | |
|---|---|---|---|---|
| 7,854,201 | B2 * | 12/2010 | Oda | 102/202.14 |
| 8,074,571 | B2 * | 12/2011 | Hirooka et al. | 102/202.14 |
| 8,434,413 | B2 * | 5/2013 | Mitsunabe et al. | 102/530 |
| 2005/0066833 | A1 * | 3/2005 | Hamilton | 102/202.5 |
| 2008/0012278 | A1 | 1/2008 | Yamazaki | |
| 2008/0063993 | A1 | 3/2008 | Katsuda et al. | |

* cited by examiner

IGNITER ASSEMBLY

This nonprovisional application claims priority under 35 U.S.C. §119(a) to Patent Application No. 2010-253423 filed in Japan on 12 Nov. 2010, and 35 U.S.C. §119(e) to U.S. Provisional Application No. 61/413,106 filed on 12 Nov. 2010, both of which are incorporated by reference.

FIELD OF THE INVENTION

The present invention relates to an igniter assembly that is suitable for use in a gas generator that is used in a restraining device such as an airbag apparatus.

BACKGROUND OF INVENTION

An igniter assembly is an essential component that is used for activating a gas generator or an actuator, and in particular an electric igniter assembly which causes a current to flow to the bridge wire and burns the ignition agent is generally used. This kind of igniter assembly is always used in a restraining device such as a gas generator, an actuator and the like, and is used by connecting a lead wire, that extends from the vehicle, to the igniter assembly.

This lead wire is used for causing an activation (ignition) current to flow to the electric igniter that is mounted on the igniter assembly. A connector is connected to the tip portion of the lead wire, and the connector is electrically connected to an electroconductive pin that is extending from the electric igniter.

After the electric igniter and the connector are connected to each other, the connection needs to be maintained firmly not to be disconnected due to vibration or the like.

Thus, conventionally, a protrusion or a recess is formed at a portion of the electric igniter where the connector is to be connected and the corresponding recess or protrusion is provided in the connector. The protrusion is fitted into the recess when the two are connected so as to prevent the connector from becoming disconnected.

FIG. 2 of JP-A No. 2008-49941 shows an axial cross-sectional view of an igniter assembly 30 that is used in a gas generator.

In the igniter assembly 30, an electric igniter 31 having a pair of electroconductive pins is surrounded and fixed by a cup-shaped metal member 32, which has a hole at the bottom portion thereof for passing an electroconductive pin therethrough, and a resin portion 33. In addition, a step is provided to the outer surface of the resin portion 33, and an annular stepped surface 33*a* is thereby formed. A holder accommodation space 36*a* (upper drawing in FIG. 2) is formed inside the resin portion 33 before the holder 40 is fitted, and a connector connection space 36 (see FIG. 1) is formed after the holder 40 is fitted.

FIG. 2 of JP-A No. 2008-18856 shows the axial cross-sectional view of the igniter assembly 40A that is used in a gas generator.

The separately molded resin holder 60 is fitted, on the inside of the igniter collar 41, in a state of coming in contact with an opening peripheral edge 37*a*, an inner wall surface of a bottom plate 13*b*, an inner wall side surface 41*a* of the igniter collar, and an inner wall ceiling surface 41*b* of the igniter collar. Unevenness is not formed on the surface of the holder 60 that is in contact with the inner wall side surface 41*a*, and the inner wall ceiling surface 41*b* of the igniter collar.

It is described that the backlash of the holder 60 can be prevented even when an external force is applied since this holder is in contact in a state of engaging with a step portion composed of the opening peripheral edge 37*a*, the bottom plate inner wall surface 13*b*, and the igniter collar inner wall side surface 41*a*.

SUMMARY OF THE INVENTION

The present invention provides an igniter assembly I including:

an igniter body having an ignition portion and an electroconductive pin;

a substantially cylindrical collar surrounding and retaining the igniter body; and a tubular holder disposed inside the collar and surrounding the electroconductive pin to connect the electroconductive pin to a connector, the igniter body, the collar and the tubular holder, being separate members from one another, being integrated by a resin (provided that the holder is not fitted by being inserted into the collar or a resin portion covering the collar), the tubular holder having a tubular body portion and a convex portion which is covered by the resin and formed on an outer circumferential surface of the tubular body portion in the diametrical direction or on an inner circumferential surface of the tubular body portion in the diametrical direction, and a fitting portion further provided to the inner circumferential surface of the tubular body portion for fitting with the connector.

The present invention provides an igniter assembly II including:

an igniter body having an ignition portion and an electroconductive pin;

a substantially cylindrical collar surrounding and retaining the igniter body; and a tubular holder disposed inside the collar and surrounding the electroconductive pin to connect the electroconductive pin to a connector, the igniter body, the collar and the tubular holder being separate members from one another, being integrated by a resin (provided that the holder is not fitted by being inserted into the collar or a resin portion covering the collar), the tubular holder having a tubular body portion and a concave portion which is covered by the resin and formed on the outer circumferential surface or the inner circumferential surface of the tubular body portion in the thickness direction of the tubular body portion, and a fitting portion further provided to the inner circumferential surface of the tubular body portion for fitting with the connector.

The present invention provides an igniter assembly III including:

an igniter body having an ignition portion and an electroconductive pin;

a substantially cylindrical collar surrounding and retaining the igniter body; and a tubular holder disposed inside the collar and surrounding the electroconductive pin to connect the electroconductive pin to a connector, the igniter body, the collar and the tubular holder, being separate members from one another, being integrated by a resin (provided that the holder is not fitted by being inserted into the collar or a resin portion covering the collar), the tubular holder having a tubular body portion and a through-hole penetrating the tubular body portion in the thickness direction and filled with the resin, and a fitting portion further provided to the inner circumferential surface of the tubular body portion for fitting with the connector.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIG. 6 shows, in (b), a perspective view of the holder used in (a) of FIG. 6;

FIG. 7 shows, in (b), a perspective view of the holder used in (a) of FIG. 7.

DETAILED DESCRIPTION OF INVENTION

In JP-A No. 2008-49941, when fitting the holder 40 (lower part of FIG. 2) into the holder accommodation space 36*a*, the hook portions 44, 45 are compressed inward, and fixed as a result of the compressed hook portions 44, 45 returning to their original shape. In order to realize this kind of fitting, the holder 40, before it is fitted, needs to have a shape which exhibits elasticity by the inner diameter being expanded outward, as is evident from FIG. 2.

Figure 3:
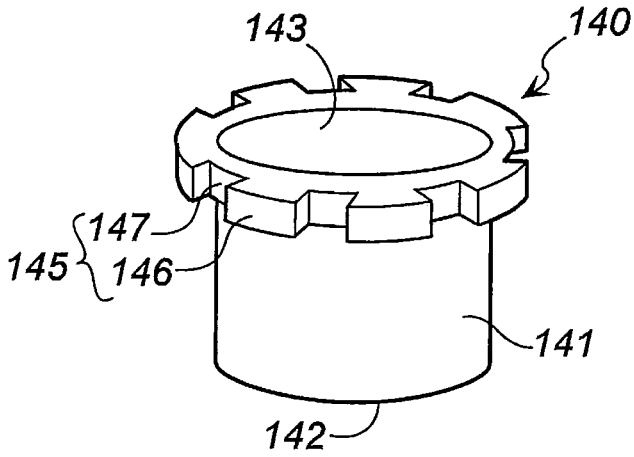
FIG. 3 shows a perspective view of the holder of another embodiment.

In addition, the hook portions 44, 45 need to be formed respectively separately from the substrates 41, 42 of the holder 40 as shown in FIG. 3(*c*) so that, when a force is applied to the hook portions 44, 45 from the outside, they are simultaneously deformed inward.

Since the structures disclosed in JP-A No. 2008-49941 and JP-A No. 2008-18856 are obtained merely by fitting and mounting separately formed components by using the elasticity thereof, there is a possibility of backlash of the components after they are mounted. Although it is possible to form the holder in a more complex shape to improve the fitting performance, the fitting operation itself will become difficult.

The present invention provides an igniter assembly capable of simplifying the shape and structure of the holder, which forms an accommodating space of the connecter and is used in the igniter assembly, and capable of enhancing the engaging strength of the holder in the igniter assembly even when the shape and structure of the holder are simplified.

The present invention igniter assembly is suitable for use in a gas generator that is used in a restraining device such as an airbag apparatus.

The igniter assembly I of the invention includes embodiments:

1. The igniter assembly I, wherein the convex portion protrudes inward or outward at a desired height of the tubular body portion.

2. The igniter assembly I or 1, wherein the convex portion is of a flange shape or a reverse flange shape formed at an opening of the tubular body portion, on the side closer to the igniter body.

3. The igniter assembly I or 1 or 2, wherein the convex portion is formed as an annular protrusion or a plurality of independent protrusions.

4. The igniter assembly I or one of 1 to 3, wherein the cross sectional shape in the diametrical direction at a portion having no convex portion of the tubular body portion is polygonal.

The igniter assembly II of the invention includes embodiments:

5. The igniter assembly II, wherein the concave portion is recessed inward at a desired height of the tubular body portion, and is formed independently in a plurality in the circumferential direction of the tubular body portion.

6. The igniter assembly II or 5, wherein the concave portion is formed in the vicinity of an opening of the tubular body portion, on the side closer to the igniter body.

The igniter assembly III of the invention includes embodiments:

7. The igniter assembly III, wherein the through-hole is formed in the thickness direction at a desired height of the tubular body portion, and is formed independently in a plurality in the circumferential direction of the tubular body portion.

8. The igniter assembly III or 7, wherein the through-hole is formed in the vicinity of an opening of the tubular body portion, on the side closer to the igniter body.

As an igniter assembly using an electric igniter, a type having an igniter body, a metal collar and a holder is known, and generally used (for example, refer to JP-A No. 2008-49941 and JP-A No. 2008-18856). Here, a "holder" is used for forming an "accommodating space of the connector" for inserting (fitting) and connecting the connector provided in a lead wire tip to the electroconductive pin of the igniter assembly.

Moreover, a type in which the igniter assembly is completed by fitting a resin holder having two elastic hook portions 44 into a resin portion covering the collar as shown in JP-A No. 2008-49941 (FIG. 2), and a type in which the igniter assembly is completed by fitting a resin holder into a metal collar as shown in JP-A No. 2008-18856 (FIG. 2) are known.

Figure 2:
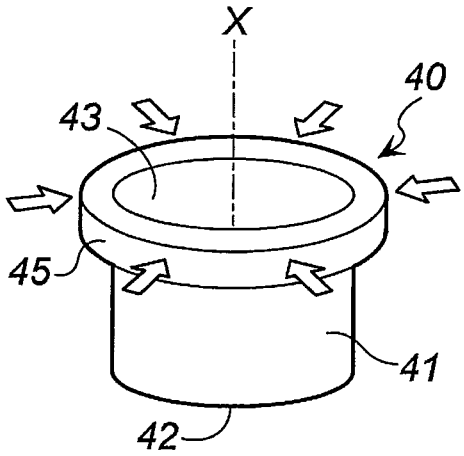
FIG. 2 shows a perspective view of the holder used in FIG. 1.

In both cases of the holder 40 shown in FIG. 2 of JP-A No. 2008-49941 and the holder 60 shown in FIG. 2 of JP-A No. 2008-18856, the holder is fitted by using the elasticity of the holder itself. Thus, a fitting operation is essential, and the shape is limited to the one, which enables fitting or having elasticity for fixation.

Since the shape of the holder is limited as described above, the change in design becomes difficult, and additionally, there may be cases where the engaging strength of the holder, with the collar or the resin portion covering the collar, is insufficient in the case of a fitting-type holder, and there is room for improvement from the perspective of enhancing the reliability in preventing backlash for a long period of time. Since the period will extend to 10 years or longer, which is the durable years of an automobile, when using the igniter assembly in a gas generator for an airbag apparatus, improvement of the engaging strength of the holder is important.

The igniter assembly of the present invention can provide with a wide variety of designs in the shape and structure for the holder, since "the igniter body, the metal collar and the holder, being separate members, are integrated by a resin (provided that the holder is not fitted into the metal collar or a resin molded body covering the metal collar)", in substitute for the igniter assembly using the fitting-type holder described in JP-A No. 2008-49941 and JP-A No. 2008-18856. In other words, there is no need to produce the holder in a special shape as in JP-A No. 2008-49941 and JP-A No. 2008-18856, and high engaging strength of the holder, to the collar or the resin portion covering the collar, can be maintained by integrating these components with a resin even in cases where the shape and structure are simplified.

That is, the holder used in the present invention is not subject to elastic deformation such that its outer diameter is substantially reduced. Thus, elasticity is not used when assembling the igniter assembly, and the material and shape of the holder can be broadly selected. Moreover, since the holder is not elastically-deformed easily, the holder is hardly dislocated once it is assembled.

The holder used in the igniter assembly of the present invention is cylindrical, and a convex portion or a concave portion or a through-hole is formed on the outer circumferential surface or the inner circumferential surface of the tubular body portion, and the inner circumferential surface has a fitting portion for fitting with the connector.

The convex portion can be formed to protrude inward or outward at the desired height of the inner circumferential surface or the outer circumferential surface of the tubular body portion. Note that the convex portion only needs to be formed on either the outer circumferential surface or the inner circumferential surface, but it can also be formed on both surfaces.

The convex portion is in a state of being covered by a resin.

The convex portion can be formed in a flange shape or a reverse flange shape formed at the opening of the tubular body portion.

The convex portion can be formed only at the opening on one end of the tubular body portion, or can also be formed at the openings on both ends. When the convex portion is formed at the opening only on one end of the tubular body portion, the convex portion side is disposed to be closer to the igniter body in the igniter assembly.

Note that a "reverse flange shape" means that a flange is formed in the inward direction of the opening of the tubular body portion relative to a flange being formed in the outward direction of the opening of the tubular body portion.

The convex portion may also be formed as a continuous annular protrusion in the peripheral direction of the tubular body portion, or as a plurality of independent protrusions.

The tubular body portion can be formed so that its cross sectional shape in the diametrical direction of the part without the convex portion is polygonal (preferably hexagonal or more).

The concave portion can be recessed inward at the desired height of the tubular body portion. The concave portion needs be formed either only on the outer circumferential surface or the inner circumferential surface, but it can also be formed on both surfaces.

The concave portion is in a state of being completely covered by a resin.

The concave portion can be formed in the vicinity of the opening only on one end of the tubular body portion, or formed in the vicinity of the opening on both ends. When the concave portion is formed in the vicinity of the opening only on one end of the tubular body portion, the concave portion side is disposed to be closer to the igniter body in the igniter assembly.

A through-hole is formed by penetrating the tubular body portion in the thickness direction. The inside of the through-hole is filled with the resin entered therein.

The through-hole can be formed at the desired height of the tubular body portion, or formed in the vicinity of the opening of the tubular body portion on a side closer to the igniter body.

The convex portion, the concave portion and the through-hole can also be formed on the tubular body portion in a combination of the convex portion and the concave portion, a combination of the convex portion and the through-hole, a combination of the concave portion and the through-hole, or a combination of the convex portion, the concave portion and the through-hole.

The igniter assembly of the present invention having the above described structure can be obtained by integrating the igniter body, the metal collar and the holder by applying a known injection molding method (for example, an insert molding method) of resin.

In the igniter assembly of the present invention, the igniter body, the collar and the holder are integrated by a resin . Thus, it is possible to simplify the shape and structure in comparison to the fitting-type holder shown in JP-A No. 2008-49941 and JP-A No. 2008-18856, and the engaging strength of the holder within the igniter assembly can also be improved.

Embodiments Of Invention

<Igniter Assembly>

Figure 1:
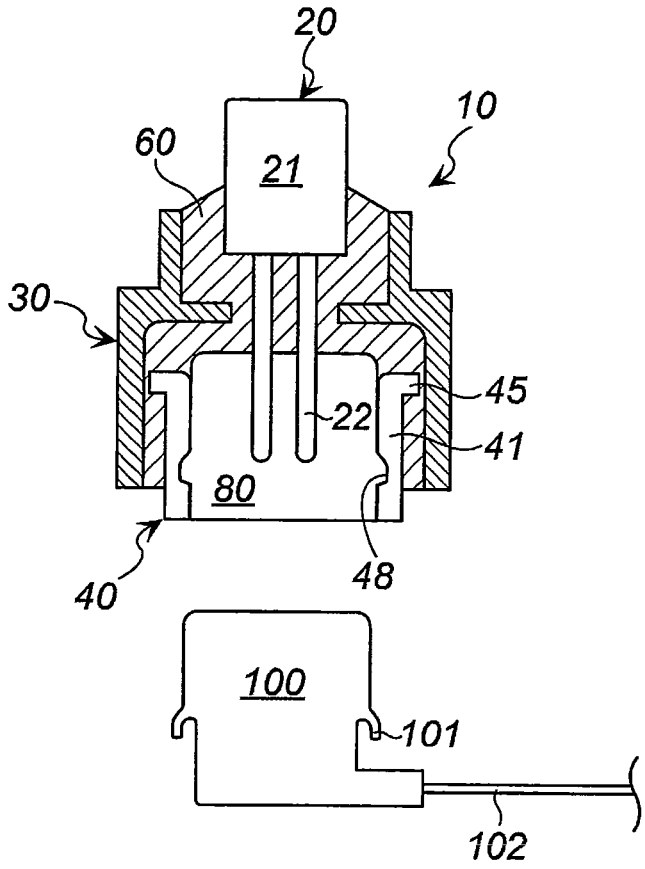
FIG. 1 shows an axial cross sectional view of the igniter assembly, and the connector that is used in combination therewith.

(1) Embodiment of FIG. 1 and FIG. 2

In the igniter assembly 10 of FIG. 1, an igniter body 20, a metal collar 30 and a holder 40, which are respectively separate components, are integrated by a resin 60.

The igniter body 20 has an ignition portion 21 and an electroconductive pin 22, and, for instance, is the same as the electric igniter 31 shown in FIG. 2 (and paragraph [0037]) of JP-A No. 2008-49941, and the igniter body 42 of FIG. 2 (and paragraph [0039]) of JP-A No. 2008-18856.

The metal collar 30 surrounds and retains the igniter body 20 via the resin 60.

The metal collar 30 does not have to surround the entire igniter body 20, and it may only partially surround the igniter body 20, and, as shown in FIG. 1, it may also surround partly the ignition portion 21 and entirely the electroconductive pin 22.

The collar 30 is of a substantially cylindrical shape as shown in the drawing in order to realize the above described function, and also has an annular protrusion toward the intended direction in order to increase the engaging strength with the resin 60.

The collar 30 can be formed in various shapes and structures for realizing the above described function, and, for example, is the same as the metal member 32 shown in FIG. 2 of JP-A No. 2008-49941, and the igniter collar 41 shown in FIG. 2 of JP-A No. 2008-18856.

The holder 40 is disposed inside the collar 30 and surrounds the electroconductive pin 22.

The internal space 80 (a space formed by the holder 40 and the resin 60 from which the electroconductive pin 22 protrudes) of the holder 40 is the accommodating space of the connector 100 to be inserted for connecting with the electroconductive pin 22.

There is no particular limitation on the material of the holder 40, and it may be a metal or a resin. In the case of a resin, it may be the same as or different from the resin 60.

The holder 40 shown in FIG. 1 and FIG. 2 has an annular convex portion 45 protruding in a flange shape from the outer circumferential surface of the opening 43 of the tubular body portion 41 toward the outside (outward in the diametrical direction) , and a fitting portion 48 for fitting with the elastic protruding portion 101 of the connector 100 is formed on the inner circumferential surface. Note that the formation of the fitting portion 48 itself is known.

The tubular body portion 41 does not have a slit or the like in the X axis direction and has a continuous peripheral wall surface. The inner diameter and the outer diameter of the portion excluding the annular convex portion 45 and the fitting portion 48 are respectively of the same dimension.

The tubular body portion 41 itself is not of the shape and structure which have elasticity as the holder 40 shown in FIG. 2 of JP-A No. 2008-49941.

Since a slit or the like is not provided as described above, there is no change in dimension (deformation such that the slit is narrowed does not occur during the assembly process) for the holder 40 prior to be fitted to the igniter assembly 10 shown in FIG. 2 and after being fitted to the igniter assembly 10 shown in FIG. 1.

The annular convex portion 45 can also be formed on the opening 42 opposite to the opening 43.

Moreover, one or more (two or three or more) rows of annular convex portions 45 can also be formed at the desired heights (desired positions in the X axis direction) of the tubular body portion 41.

The igniter assembly 10 is obtained by integrating the igniter body 20, the metal collar 30 and the holder 40, being separate members, by the resin 60 that is injected based on a known method, and the holder 40 is not fitted by being inserted into the metal collar 30 or the resin portion 60 covering the metal collar 30.

Note that, when the annular convex portion 45 is also provided on the opening 42, that portion can also be covered by the resin 60.

With the igniter assembly 10 shown in FIG. 1, the annular convex portion 45 of the holder 40 is in a state of embedding into the resin 60 (that is, a state where the annular convex portion 45 is completely covered by the resin 60), and since the annular convex portion 45 is not elastically-deformed even when it is pushed from the outside (in the arrow direction of FIG. 2), the engaging strength of the holder 40 and the resin 60 (that is, the engaging strength with the collar 30 via the resin 60) can be enhanced.

Note that, in FIG. 2 of JP-A No. 2008-49941 and FIG. 2 of JP-A No. 2008-18856, it is structurally impossible to fit the holder 40 having a shape as shown in FIG. 2 of the present invention without causing any gaps.

(2) Embodiment of FIG. 3

With the igniter assembly 10 shown in FIG. 1, the holder 140 shown in FIG. 3 can be used in place of the holder 40 shown in FIG. 2.

The holder 140 shown in FIG. 3 has an annular convex portion 145 protruding in a flange shape from the outer circumferential surface on the opening 143 of the tubular body portion 141 toward the outside (outward in the diametrical direction).

As with the holder 40 of FIG. 2, the tubular body portion 141 does not have a slit or the like and has a continuous peripheral wall surface. Thus, even when the annular convex portion 145 is pushed in the arrow direction of FIG. 2, such deformation that the diameter becomes reduced will not occur. Thus, the inner diameter and the outer diameter excluding the annular convex portion 145 and the fitting portion (corresponding to the fitting portion 48 of FIG. 1) not shown are respectively of the same dimension before and after the assembly and during the assembly process.

In the annular convex portion 145, the independent convex portion 146 and the concave portion 147 are alternately formed in the peripheral direction.

One or more (two or three or more) rows of annular convex portions 145 can also be formed at the desired heights (desired positions in the X axis direction) of the tubular body portion 141.

When the holder 140 is used in the igniter assembly 10 shown in FIG. 1, the annular convex portion 145 (combination of the independent convex portion 146 and the concave portion 147) of the holder 140 is in a state of embedding into the resin 60 (that is, a state where the annular convex portion 145 is completely covered by the resin 60) , and since the annular convex portion 145 is not deformed, the engaging strength of the holder 140 and the resin 60 (that is, the engaging strength with the collar 30 via the resin 60) can be enhanced.

Moreover, based on the function of the annular convex portion 145 (combination of the independent convex portion 146 and the concave portion 147), the rotation prevention effect of the holder 140 in the peripheral direction for the igniter assembly 10 is enhanced.

Figure 4:
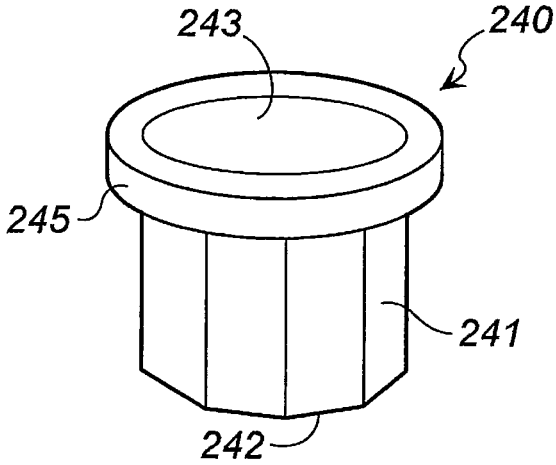
FIG. 4 shows a perspective view of the holder of yet another embodiment.

(3) Embodiment of FIG. 4

With the igniter assembly 10 shown in FIG. 1, the holder 240 shown in FIG. 4 can be used in substitute for the holder 40 shown in FIG. 2.

The holder 240 shown in FIG. 4 includes an annular convex portion 245 protruding in a flange shape from the outer circumferential surface on the opening 243 of the tubular body portion 241 toward the outside (outward in the diametrical direction).

Thus, with the tubular body portion 241, the inner diameter and the outer diameter excluding the annular convex portion 245 and the fitting portion (corresponding to the fitting portion 48 of FIG. 1) not shown are respectively of the same dimension before and after the assembly and during the assembly process.

In the holder 240, the cross sectional shape in the diametrical direction of the portion without the annular convex portion 245 of the tubular body portion 241 is polygonal (preferably hexagonal to decagonal).

The annular convex portion 245 has the same shape as the annular convex portion 45 shown in FIG. 2, but it can also have the same shape as the annular convex portion 145 shown in FIG. 3.

One or more (two or three or more) rows of annular convex portions 245 can also be formed at the desired heights of the tubular body portion 241.

In the holder 240, the annular convex portion 245 can be polygonal and the tubular body portion 241 can be circular, or both the annular convex portion 245 and the tubular body portion 241 can be polygonal.

When the holder 240 is used in the igniter assembly 10 shown in FIG. 1, the annular convex portion 245 of the holder 240 and at least a part of the polygonal tubular body portion 241 are in a state of embedding into the resin 60 (that is, a state where the annular convex portion 145 is completely covered by the resin 60), and the engaging strength of the holder 240 and the resin 60 (that is, the engaging strength with the collar 30 via the resin 60) can be enhanced.

Moreover, with the holder 240, since the cross sectional shape in the diametrical direction of the portion without the annular convex portion 245 of the tubular body portion 241 is polygonal, the rotation prevention effect of the holder 240 in the peripheral direction for the igniter assembly 10 is enhanced.

Figure 5:
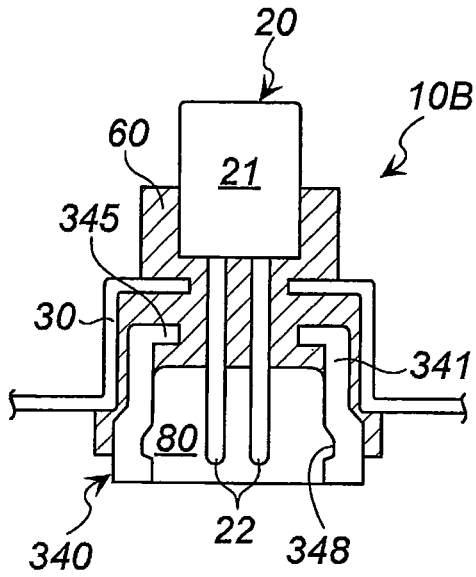
FIG. 5 shows an axial cross sectional view of the igniter assembly of another embodiment.

(4) Embodiment of FIG. 5

With the igniter assembly 10B of FIG. 5, the igniter body 20, the metal collar 30 and the holder 340, being separate members from one another, are integrated by the resin 60.

In the igniter assembly 10B of FIG. 5, the shapes of the collar 30, the holder 340 and the resin 60 are different in comparison to the igniter assembly 10 of FIG. 1. Nevertheless, as explained above, the collar 30 itself is known and its shape can be modified as needed, and the shape of the resin 60 can also be changed according to the shape of the collar 30.

The holder 340 shown in FIG. 5 has an annular convex portion 345 protruding in a reverse flange shape from the inner circumferential surface of the opening on one end side of the tubular body portion 341 toward the inside (inward in the diametrical direction), and additionally has a fitting portion 348.

With the tubular body portion 341, the inner diameter of the portion excluding the annular convex portion 345 and the fitting portion 348 is of the same dimension before and after the assembly and during the assembly process.

Although, the outer diameter of the tubular body portion 341 except for the portion corresponding to the annular convex portion 345 changes in two steps, such stepped portion can be eliminated so that the outer diameter becomes an uniform dimension.

In the igniter assembly 10B shown in FIG. 5, the annular convex portion 345 of the holder 340 is in a state of embedding into the resin 60 (that is, a state where the annular convex portion 345 is completely covered by the resin 60), and since the holder is not deformed such that the diameter is reduced, the engaging strength of the holder 340 and the resin 60 (that is, the engaging strength with the collar 30 via the resin 60) can be enhanced.

Figure 6:
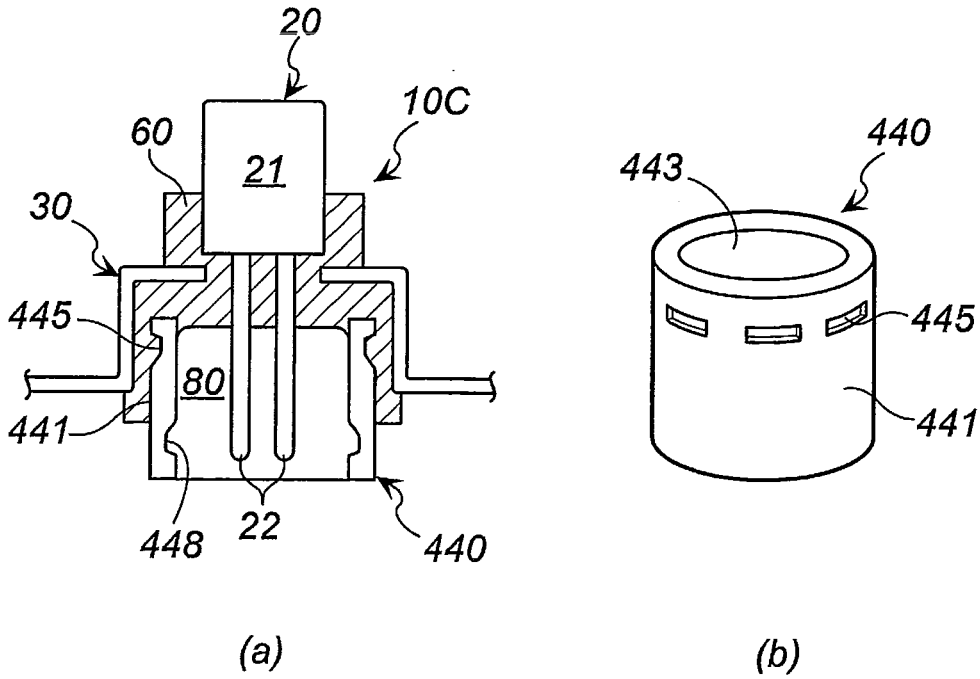
FIG. 6 shows, in (a), an axial cross sectional view of the igniter assembly of yet another embodiment.

(5) Embodiment of FIG. 6

In the igniter assembly 10C of FIG. 6(*a*), the igniter body 20, the metal collar 30 and the holder 440 of FIG. 6(*b*), being separate members from one another, are integrated by the resin 60.

With the igniter assembly 10C of FIG. 6(*a*), the shapes of the collar 30, the holder 440 and the resin 60 are different in comparison to the igniter assembly 10 of FIG. 1. Nevertheless, as explained above, the collar 30 itself is known and its shape can be modified as needed, and the shape of the resin 60 can also be changed according to the shape of the collar 30.

The holder 440 shown in FIG. 6(*b*) has a plurality of concave portions 445 formed independently in a peripheral direction on the outer circumferential surface in the vicinity of the opening 443 of the tubular body portion 441.

With the tubular body portion 441, the inner diameter and the outer diameter of the portion excluding the concave portion 445 and the fitting portion 448 is of the same dimension before and after the assembly and during the assembly process .

The plurality of rows of concave portions 445 can also be formed at the desired height of the tubular body portion 441.

The igniter assembly 10C is obtained by integrating, by resin 60, the igniter body 20, the metal collar 30 and the holder 440 which are separate members from one another, and the holder 440 is not fitted by being inserted into the metal collar 30 or the resin portion 60 covering the metal collar 30.

In the igniter assembly 10C shown in FIG. 6, the resin 60 is in a state of filling in the concave portion 445 of the holder 440 (that is, a state where the concave portion 445 is completely covered by the resin 60), and since the holder is not deformed such that the diameter is reduced, the engaging strength of the holder 440 and the resin 60 (that is, the engaging strength with the collar 30 via the resin 60) can be enhanced.

Moreover, in the holder 440, since the resin 60 is filled in the concave portion 445, the rotation prevention effect of the holder 440 in the peripheral direction for the igniter assembly 10 is enhanced.

Figure 7:
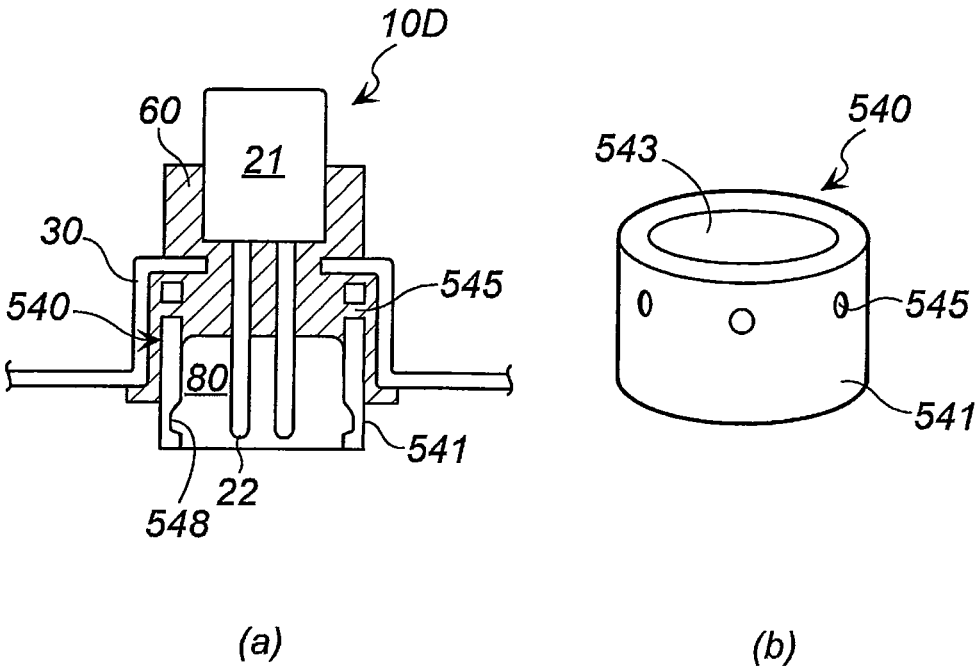
FIG. 7 shows, in (a), an axial cross sectional view of the igniter assembly of yet another embodiment.

(6) Embodiment of FIG. 7

The igniter assembly 10D of FIG. 7 (a) is of a different embodiment than the igniter assembly 10C shown in FIG. 6(*a*), and is obtained by integrating, by the resin 60, the igniter body 20, the metal collar 30 and the holder 540 which are separate member from one another, shown in FIG. 7(*b*).

The holder 540 shown in FIG. 7(*b*) has a plurality of through-holes 545 formed independently in the peripheral direction in the vicinity of the opening 543 of the tubular body portion 541.

With the tubular body portion 541, the inner diameter and the outer diameter of the portion excluding the fitting portion 548 is of the same dimension before and after the assembly and during the assembly process.

The plurality of rows of through-holes 545 can be formed in the peripheral direction at the desired height of the tubular body portion 541, or otherwise formed by being dispersed appropriately (preferably such that they are dispersed so that even intervals are formed between adjacent through-holes).

The igniter assembly 10D of FIG. 7(*a*) is obtained by integrating, by the resin 60, the igniter body 20, the metal collar 30 and the holder 540 which are separate member from one another, and the holder 540 is not fitted by being inserted into the metal collar 30 or the resin portion 60 covering the metal collar 30.

In the igniter assembly 10D shown in FIG. 7(*a*), since the resin is in a state of being filled in the through-holes 545 as a result of the resin 60 entering the through-holes 545 of the holder 540, the engaging strength of the holder 540 and the resin 60 (that is, the engaging strength with the collar 30 via the resin 60) can be enhanced.

Moreover, with the holder 540, since the resin 60 is filled in the through-holes 545, the rotation prevention effect of the holder 540 in the peripheral direction for the igniter assembly 10 is enhanced.

Figure 8:
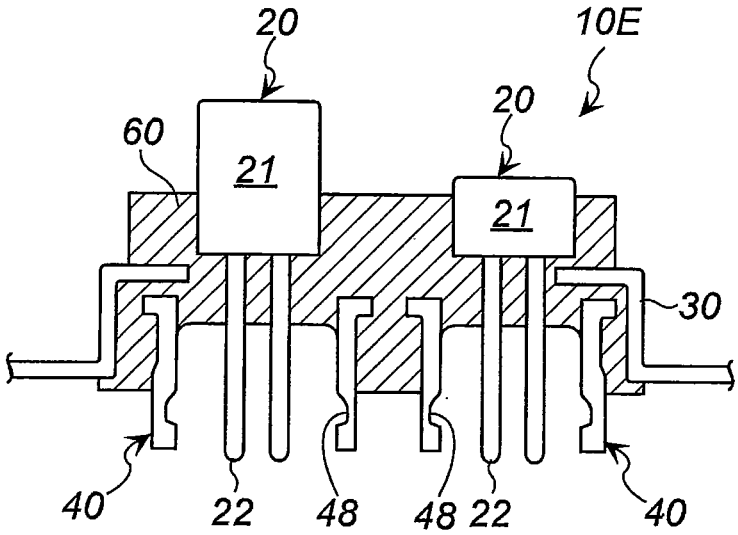
FIG. 8 shows an axial cross sectional view of the igniter assembly of yet another embodiment.

(7) Embodiment of FIG. 8

The igniter assembly 10E of FIG. 8 uses two igniter bodies 10, a single collar 30, and two holders 40.

In this embodiment, two collars 30 can be used, or only a single holder 40 can be used.

<Manufacturing Method of Igniter Assembly>

The manufacturing method of the igniter assembly of the present invention will be explained. With the manufacturing method of the present invention, a known insert molding method can be applied.

Foremost, so as to achieve the structure shown in FIG. 1, FIG. 5, FIG. 6(*a*), FIG. 7(*a*), and FIG. 8, the igniter body, the collar and the holder are placed in a mold so that an interval is formed between the respective components.

Subsequently, molten resin is injected into the mold. Known resin such as polyamide such as polyamide 66 and polyamide 612, polyarylate, polybutylene terephthalate, polyphenylene sulfide, liquid crystal polymer or the like can be used. Moreover, from the perspective of improving the mechanical strength, it is also possible to use a resin composition which is mixed with fiber fillers such as glass fibers or carbon fibers, or powder fillers.

Note in the holder 140 shown in FIG. 3 that, in order to firmly fix the holder to the collar when injecting molten resin, it is also possible to use a holder provided with a combination of the convex portion 146 protruding axially (in the same direction as the X axis direction shown in FIG. 2) and the concave portion 147, in substitute for the combination of the independent convex portion 146 formed outward in the diametrical direction and the concave portion 147, and cause the convex portion 146 to come in contact with the inner wall surface of the mold. Consequently, a hole is formed between the inner wall surface of the mold and the concave portion 147, and this hole becomes the passage for the molten resin.

Moreover, the above convex portion 146 and the concave portion 147 are provided to the upper end in the axial direction (in the same direction as the X axis direction shown in FIG. 2) of the holder 340 shown in FIG. 5 (the convex portion 146 is formed, in the X axis direction, above the annular convex portion 345), and the mold is used to press the annular convex portion 345 upward during the injection molding of the resin 60. Consequently, the convex portion 146 comes firmly in contact with the lower surface of the collar 30, and the holder 340 is more firmly fixed to the collar 30. Moreover, since the mold and the annular convex portion 345 are also in firm contact, there is no room for the injected resin to enter, and it is thereby possible to prevent the occurrence of burrs caused by the resin.

Here, the convex portion 146 and the concave portion 147 are used for forming a passage with the collar 30 for the resin 60 to pass through, and guides the resin 60 that was injected inside the holder 340 (convex portion 146) toward the outside. In substitute for the convex portion 146 and the concave portion 147, it is also possible to form a tubular wall (extended tubular wall) which continues to the tubular body portion 341 in the X axis direction of the annular convex portion 345, and form a through-hole to serve as the passage of the resin in the extended tubular wall.

The assembly is subsequently cooled and removed from the mold. Since the resin shrinks during the cooling process, in the case of the igniter assembly 10 of FIG. 1, for example, based on this shrinkage of the resin, the collar 30 that is embedded in the resin 60 is tightened from either side in the thickness direction and the annular convex portion 45 of the holder 40 is tightened from either side in the thickness direction, and the engaging strength of the igniter body 20, the collar 30 and the holder 40 can thereby be improved.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An igniter assembly comprising:

an igniter body having an ignition portion and an electroconductive pin;

a substantially cylindrical collar surrounding and retaining the igniter body; and a tubular holder disposed inside the collar and surrounding the electroconductive pin to allow the electroconductive pin to be connected to a connector connected to a lead wire for supplying ignition current to the electroconductive pin to activate the igniter body, the tubular holder defining, therein, an open internal space for receiving and accommodating the connector, the igniter body, the collar and the tubular holder, being separate members from one another, being integrated by a resin, the tubular holder having a tubular body portion and a convex portion extending from the tubular body portion in the diametrical direction of the tubular holder, at least the convex portion being covered by the resin, and the open internal space being defined by an inner circumferential surface of the tubular body portion exposed to the open internal space and the resin such that the electroconductive pin protrudes from the resin to the open internal space, and the connector being configured to be connected to the electroconductive pin within the open internal space, and the tubular holder having a fitting portion formed in the inner circumferential surface of the tubular body portion, the fitting portion being configured to engage with an engaging portion, provided to the connector, when the connector is received in the open internal space to prevent the connector from disconnecting from the electroconductive pin.

2. The igniter assembly according to claim 1, wherein the convex portion protrudes inward or outward at a desired height of the tubular body portion.

3. The igniter assembly according to claim 1, wherein the convex portion is of a flange shape or a reverse flange shape formed at an opening of the tubular body portion, on the side closer to the igniter body.

4. The igniter assembly according to claim 1, wherein the convex portion is formed as an annular protrusion or a plurality of independent protrusions.

5. The igniter assembly according to claim 1, wherein the cross sectional shape in the diametrical direction at a portion having no convex portion of the tubular body portion is polygonal.

6. An igniter assembly comprising:

an igniter body having an ignition portion and an electroconductive pin;

a substantially cylindrical collar surrounding and retaining the igniter body; and a tubular holder disposed inside the collar and surrounding the electroconductive pin to allow the electroconductive pin to be connected to a connector connected to a lead wire for supplying ignition current to the electroconductive pin to activate the igniter body, the tubular holder defining, therein, an open internal space for receiving and accommodating the connector, the igniter body, the collar and the tubular holder being separate members from one another, being integrated by a resin, the tubular holder having a tubular body portion and a concave portion formed in one of an outer circumferential surface and an inner circumferential surface of the tubular body portion in a thickness direction of the tubular main body portion, at least the concave portion being covered by the resin, and the open internal space being defined by an inner circumferential surface of the tubular body portion exposed to the open internal space and the resin such that the electroconductive pin protrudes from the resin to the open internal space, and the connector being configured to be connected to the electroconductive pin within the open internal space, and the tubular holder having a fitting portion formed in the inner circumferential surface of the tubular body portion, the fitting portion being configured to engage with an engaging portion, provided to the connector, when the connector is received in the open internal space to prevent the connector from disconnecting from the electroconductive pin.

7. The igniter assembly according to claim 6, wherein the concave portion is recessed inward at a desired height of the tubular body portion, and includes a plurality of recesses formed in the circumferential direction of the tubular body portion.

8. The igniter assembly according to claim 6, wherein the concave portion is formed in the vicinity of an opening of the tubular body portion, on the side closer to the igniter body.

9. The igniter assembly according to claim 2, wherein the convex portion protrudes inward.

10. The igniter assembly according to claim 1, wherein at least a portion of the collar extends between the ignition portion and the tubular holder.

11. The igniter assembly according to claim 1, wherein the convex portion extends in a direction parallel to a portion of the collar that extends between the ignition portion and the tubular holder.

12. The igniter assembly according to claim 6, wherein the concave portion is formed in the outer circumferential surface of the tubular body portion.

13. The igniter assembly according to claim 12, wherein the concave portion opposes at least a portion of the cylindrical collar.

14. The igniter assembly according to claim 8, wherein the concave portion is formed in the vicinity of the opening of the tubular body portion, on the side closer to the igniter body compared to the fitting portion.

15. The igniter assembly according to claim 6, wherein at least a portion of the collar extends between the ignition portion and the tubular holder.

* * * * *